United States Patent [19]

Mead

[11] 4,417,677

[45] Nov. 29, 1983

[54] TAPE DISPENSER

[76] Inventor: Gary G. Mead, 12791 Barrett La., Santa Ana, Calif. 92705

[21] Appl. No.: 308,921

[22] Filed: Oct. 5, 1981

[51] Int. Cl.[3] ..... B26D 1/02; B65D 85/672

[52] U.S. Cl. ..... 225/26; 225/53; 225/57; 225/90; 225/91

[58] Field of Search ..... 225/26, 25, 53, 57, 225/77, 90, 91, 48–50

[56] References Cited

U.S. PATENT DOCUMENTS

| | | | |
|---|---|---|---|
| 2,262,260 | 11/1941 | Smith . | |
| 2,309,396 | 1/1943 | Jackson | 225/47 X |
| 2,333,378 | 11/1943 | Jackson | 225/91 X |
| 2,414,333 | 1/1947 | Schieman | 225/90 X |
| 2,447,518 | 8/1948 | Marinsky . | |
| 2,528,958 | 11/1950 | Johnson . | |
| 2,560,394 | 7/1951 | Slezak | 225/25 |
| 2,609,877 | 9/1952 | Hanington . | |
| 2,612,322 | 9/1952 | Gall | 225/25 |
| 2,640,657 | 6/1953 | Guyer | 225/25 X |
| 2,987,232 | 6/1961 | Burdick et al. | 225/26 |
| 2,992,727 | 7/1961 | Zeitter | 242/55.53 |
| 3,069,105 | 12/1962 | Press et al. . | |
| 3,086,309 | 4/1963 | Katz | 225/25 X |
| 3,144,184 | 8/1964 | Yerkes | 225/26 |
| 3,149,764 | 9/1964 | Waltz | 225/57 |
| 3,237,827 | 3/1966 | Domenico et al. | 225/77 X |
| 3,484,030 | 12/1969 | Mattheis | 225/65 |
| 3,613,973 | 10/1971 | Jaeschke | 225/47 |
| 3,815,801 | 6/1974 | Perrin | 225/47 |
| 3,913,786 | 10/1975 | Kartasuk | 221/70 |
| 3,970,230 | 7/1976 | Horn | 225/65 |

FOREIGN PATENT DOCUMENTS

| | | | |
|---|---|---|---|
| 1040543 | 10/1953 | France | 225/26 |

*Primary Examiner*—Frank T. Yost

*Attorney, Agent, or Firm*—Gausewitz, Carr, Rothenberg & Edwards

[57] ABSTRACT

A dispenser for rolls of adhesive tape is described. The dispenser includes a parallelepiped receptacle for a roll of tape, with an opening for drawing the tape from the receptacle and a cutting means adjacent the opening for severing the tape. The dispenser may include an angle member to serve both as a cutting means and a retaining surface and also serve to strengthen the receptacle in cooperation with a strengthening panel beneath the angle member.

21 Claims, 7 Drawing Figures

TAPE DISPENSER

BACKGROUND OF THE INVENTION

This invention relates to the field of portable dispensers for adhesive or pressure-sensitive tape.

It is well known in the art to provide receptacles or containers for pressure-sensitive tape, e.g., transparent or other thin plastic tape or paper tape, which containers are equipped with a cutting device, typically a flat element having plastic or metal teeth suitable for tearing the tape. Typically, such prior art devices are designed so that a roll of tape can be positioned in them, and when it is desired to use a portion of the tape, the user unrolls a desired segment of tape and then draws the tape across the cutting edge, severing the segment from the remainder of the roll. This leaves an end portion of tape extending from the unused or stored roll to the cutting edge. After use of the dispenser, such an end portion is left suspended only on the teeth of the cutting edge. Consequently, the suspended portion often comes loose from the teeth and falls back onto the roll and adheres there. This makes it necessary for the user to find the end where it adheres to the roll and disengage or free a portion of it to grasp each time the device is used. Also, when the suspended portion falls back against the roll, it may be in a wrinkled or distorted configuration or it may contact an inner wall of the container, such that, in either case, the adhesive characteristics of the segment are reduced or destroyed. This makes it necessary to sever and discard the ruined portion before the device is next used.

The problem of having the end of the tape suspended only on the teeth of the cutting edge can be eliminated by running the portion over a wide flat surface between the stored roll and the cutting edge. With this kind of device, the segment of tape running from the unused roll to the cutting edge (when the dispenser is not in use) will contact and adhere to the wide surface sufficiently securely to keep it from falling back into the dispenser and adhering to the roll or to the inner walls. Unfortunately, when the tape is stored in this manner, i.e., in contact with a wide supporting surface between the roll and the cutting edge, this also may ruin the adhesive characteristics of the contacted portion of the tape when it is pulled loose from the wide surface. Also, this type of device will make it difficult for the user to grasp the end portion of the tape, and, typically, one will have to scrape the tape loose from the wide surface, again destroying a segment, which will have to be discarded before the remainder can be used.

Lack of structural rigidity is still another problem with prior art tape dispensers. It is highly desirable to make dispensers from inexpensive paperboard or cardboard so that they can be discarded after the tape is consumed. However, for such inexpensive dispeners the structures are often flimsy and tend to be torn or damaged long before the roll of tape is consumed. When the cutting edge is supported on a flimsy structure of that type, it is often difficult to use it to tear the tape, since the structure is not sufficiently rigid to resist being deformed, and thus it yields or even collapses when the user attempts to draw the tape across the cutting edge.

There has been a long felt need for an inexpensive disposable dispenser which was sufficiently sturdy to be durable and long-wearing. It is also desirable to provide such a dispenser that is designed to provide a means for allowing the user to grip the end of the tape for pulling it from the roll without the necessity of scraping it loose from either the body of the dispenser or from the roll of tape itself. It is also desirable that such a dispenser be provided with a means for supporting the end portion of the tape when the dispenser is not in use, so that the end portion will adhere somewhat to the cutting device, and yet will not adhere so tightly that its adhesive qualities are significantly diminished when it is pulled loose for use.

These and other objects are achieved in accordance with the present invention.

SUMMARY OF THE INVENTION

This invention contemplates a tape dispenser in the general form of a rectangular parallelepiped for holding and dispensing adhesive tape from a tubular roll. The dispenser comprises a receptacle having an aligned parallel pair of substantially rectangular side walls, a base wall connecting the lower edges of the side walls, a top panel connecting corresponding segments of the upper edges of the side walls, the top panel and side walls defining an opening for dispensing tape from the roll, and cutting means adjacent the opening for cutting the tape. The invention may also include a front panel or stiffening member positioned between the front edges of the side walls to provide structural support beneath the cutting edge, and a similar panel between the rear edges.

The cutting means of the invention may comprise an elongated angle member mounted transversely to the rectangular side walls along a corner portion of the upper edges thereof. The angle member serves multiple functions and includes an easy-release planar retaining surface for releasably securing the tape when the dispenser is not in use, a cutting edge along said surface for severing the tape, and a positioning member for maintaining the end portion of the tape at a low, acute angle relative to the planar retaining surface.

DETAILED DESCRIPTION OF THE INVENTION

Figure 1:
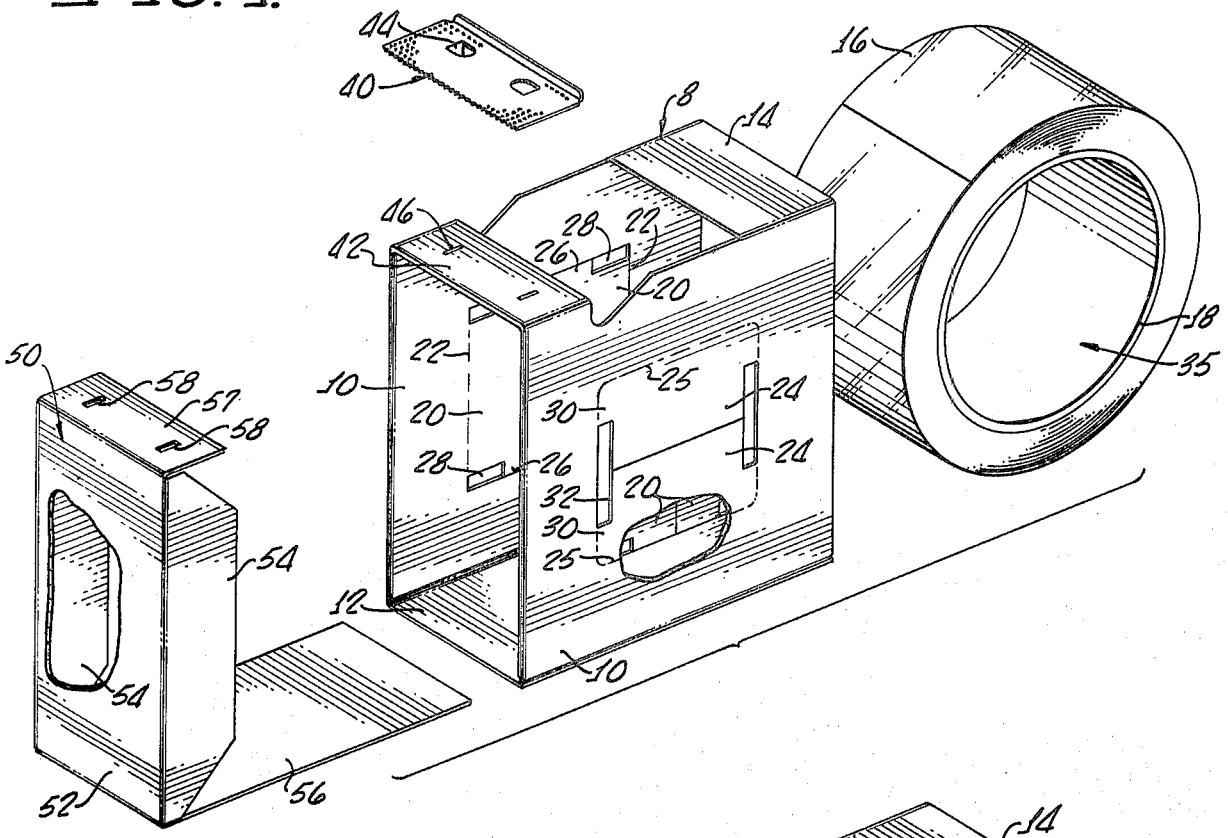
FIG. 1 is a partially cutaway, exploded perspective view showing a roll of tape and the components of a tape dispenser constructed in accordance with the present invention.
Figure 2:
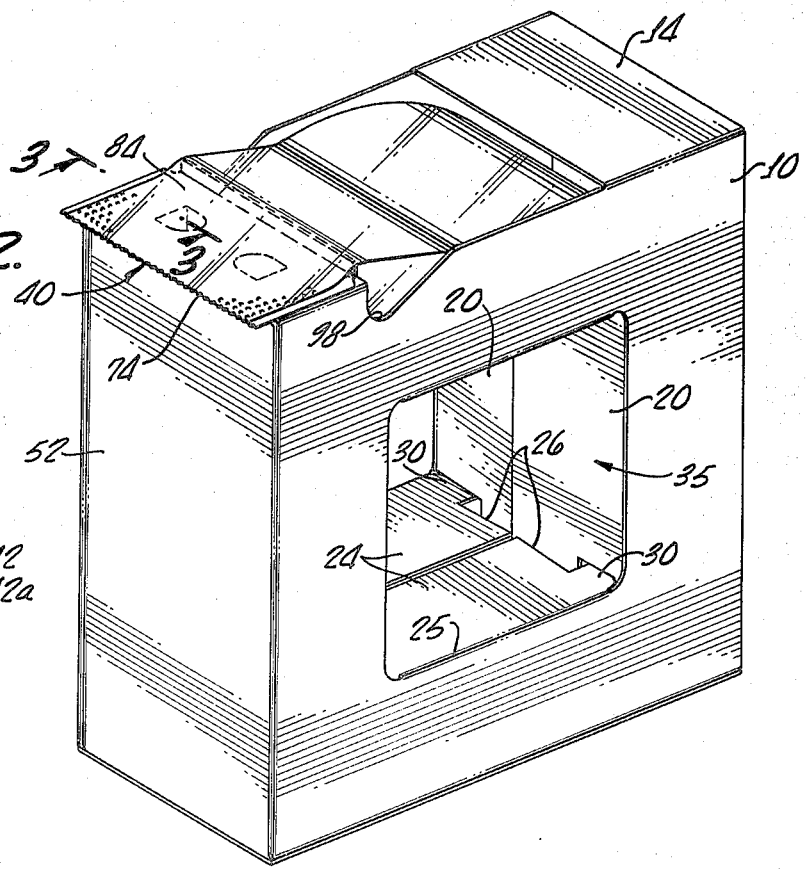
FIG. 2 is a perspective view of the tape and dispenser fully assembled for use.

Referring first to FIGS. 1 and 2 of the drawings, there is shown a generally parallelepiped receptacle 8 open at the ends. The receptacle 8 is formed of a pair of aligned parallel side walls 10, a base wall 12 connecting the side walls along their lower edges, and a top panel 14 running transversely between corresponding segments of the upper edges of the side walls. The receptacle 8 is sized for enclosing and containing a tape roll 16 on a core or spool 18 for housing the tape roll, the axis of the spool running perpendicular to the side walls, as shown in FIG. 2.

In the preferred design of FIGS. 1 and 2 a desirable means for retaining the tape within the receptacle is shown. This is a prior art recognized means and is not essential to the invention herein but provides a preferred design in combination therewith. The means for retaining the tape within the receptacle consists of a double-walled compartment of inner flaps 20 hinged along vertical creases 22 and outer flaps 24 hinged along horizontal creases 25. The upper and lower edges of the inner flaps 20 define tabs 26 and notches 28 for engaging corresponding tabs 30 and notches 32 of outer flaps 24, as shown in FIG. 2.

Figure 4:
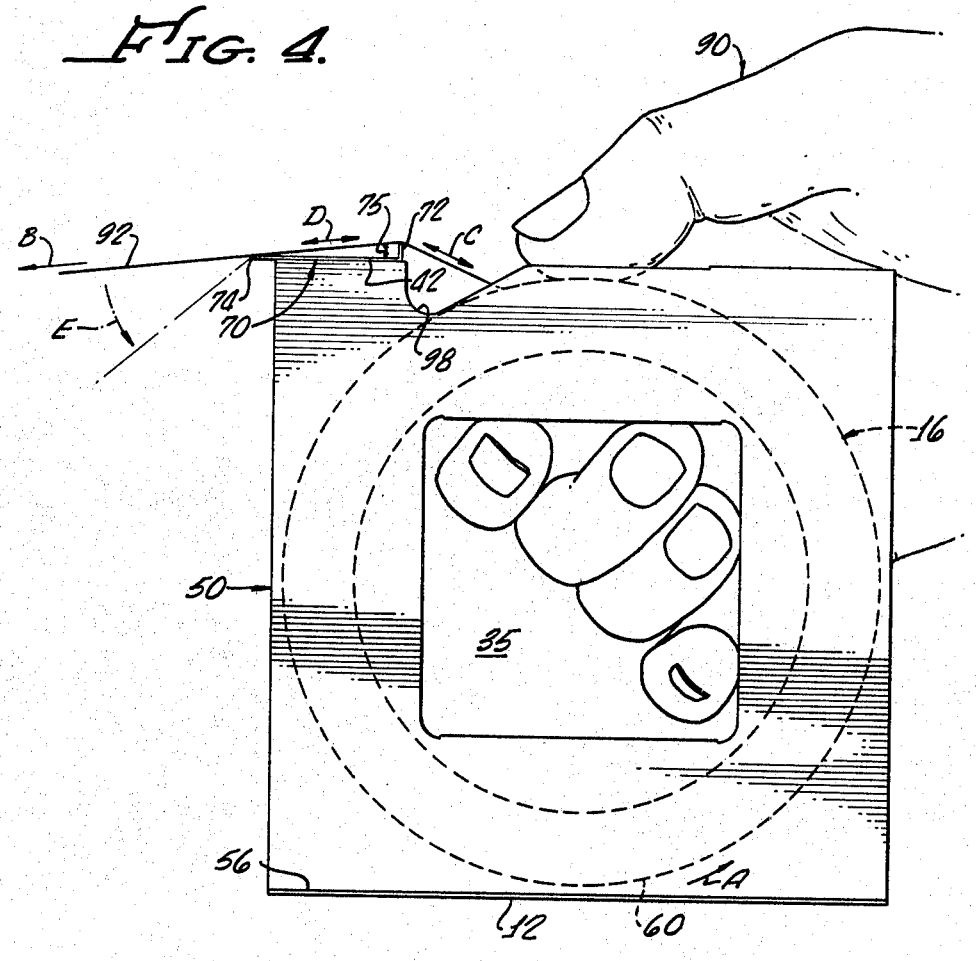
FIG. 4 is a side elevation view showing the positioning of the hand of a user with the dispenser.

When the tape is in position between the side walls 10, the flaps 20 and 24 are pressed into the opening 35 within the core 18 of the tape roll, thus defining a handhold for the user to grip the dispenser, as shown in FIG. 4.

As shown in FIGS. 1 and 2, an angle member 40 is mounted on an angle member support panel 42 extending between and connecting a corner portion of the upper edges of the side walls 10. The angle member 40 comprises sufficiently stiff material to provide strength and rigidity, but has sufficient flexibility that in the preferred embodiment of the invention it can be formed and bent into the shape shown from a unitary piece of material, such as aluminum or other metal or alloy.

Angle member 40 includes a pair of tabs 44 sized to match the mounting slots 46 in angle member support panel 42. In the embodiment shown there is also included a front panel or stiffening member 50 comprising a front wall portion 52, a pair of side insert members 54, a base insert member 56, and a top insert member 57. The front panel 50 can be formed of cardboard creased as shown in FIG. 1 and fitted into the receptacle 8.

Figure 3:
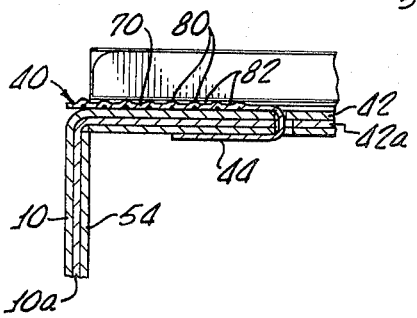
FIG. 3 is a sectional view taken along lines 3—3 of FIG. 2.

The front panel or stiffening member 50 includes mounting slots 58 compatibly positioned to align with mounting slots 46 in the support panel 42 for securing the panel 50 in position by bending tabs 44, as shown in FIG. 3. FIG. 3 also shows a particularly preferred construction of double side walls 10 and 10*a*, and a support panel with double panels 42 and 42*a*. As shown, the walls of the support panel are preferably unitary with the side walls.

A feature of the construction of the receptacle and front panel 50, as used in the present combination, is that there is no requirement that base insert member 56 of the front panel 50 be secured to base wall 12 of receptacle 8, since, as shown in FIG. 4, the outer surface 60 of the roll 16 rotates counterclockwise in the direction shown by the arrow A, and any drag or frictional forces will tend to keep the front panel 50 in place by pulling base insert member 56 to the right.

Another aspect of the invention is in the preferred construction of angle member 40. As shown in the drawings, the angle member serves multiple functions and includes an easy-release planar retaining surface 70 from which extend the tabs 44 that retain the angle member in position on the receptacle. The angle member also includes a positioning member 72 which consists of a planar element extending generally upwardly from the retaining surface 70 at the opposite edge of the retaining surface from the cutting edge 74. The cutting edge 74 and the upper edge 76 of the positioning member 72 are positioned substantially parallel to one another and to the axis of tape roll 16.

Figure 5:
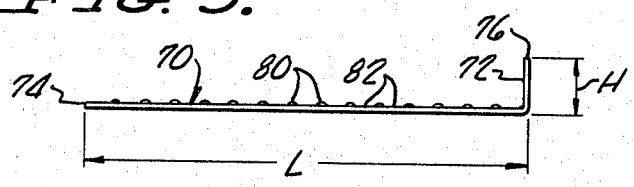
FIG. 5 is an enlarged side elevation view of the angle member.

As shown in detail in FIGS. 3 and 5, the retaining surface 70 is embossed with multiple protrusions 80 to give the retaining surface 70 easy-release characteristics when used with conventional adhesive tapes. The embossment of surface 70 enables the user to press a segment of tape down upon the surface 70, as shown in FIG. 2, so that it will adhere and remain in the position shown when the tape is not in use, and yet the tape can be easily removed from the surface without significant deterioration of its adhesive characteristics. This result is achieved by providing a sufficient number of protrusions 80 to substantially support the tape without its adhering to the portions 82 between protrusions 80. Thus, the actual surface area of the protrusions 80 in contact with the tape constitutes less than about 25% of the nominal area of surface 70 and, preferably, less than about 10% of the surface.

The dimension L, as shown in FIG. 5, depicting the length of the retaining surface 70, generally ranges more than about $\frac{1}{4}$ of the width of the tape being used and preferably ranges from about $\frac{1}{3}$ to about 1.5 times the width of the tape. The height H of positioning member 72 is in the range slightly greater than the height of the protrusions 80, but less than the length L. Generally, H is in the range between about two tape thicknesses greater than the height of protrusions 80 and up to about $\frac{1}{4}$ of the length L. In the particularly preferred embodiments of the invention, the height H ranges less than about $\frac{1}{8}$ of length L. Thus, the angle 75 (shown in FIG. 4) between the stressed tape and the plane of the surface 70 which terminates on the cutting edge 74 is less than about 45° for an angle member in which the positioning member 72 is perpendicular to surface 70. Generally, the angle 75 is a low acute angle less than 15°, and in preferred embodiments of the invention it is less than about 7°.

The positioning member 72 affects the fraction of the segment 84 of the tape (as shown in FIG. 2) which can be pressed down upon the embossed retaining surface 70 when the dispenser is not in use. Positioning member 72 also affects the manner of use of the dispenser, as well as the angle between the tape and the cutting edge, as shown in FIG. 4. Therein it is shown that the user's hand 90 grips the dispenser with the fingers in the handhold 35 while the thumb presses down upon the tape roll 16 to stop rotation of the roll within the dispenser, after a sufficient segment 92 of tape has been withdrawn. The adhesive side of the segment 92 faces downwardly toward the dispenser. The user pulls outwardly in the direction of arrow B while gripping the tape roll to keep it from turning, thus causing the tape to be stressed, as shown by arrows C and D, over positioning member 72. The user then pulls the stressed tape downwardly, as shown by arrow E, to cut or sever the tape along cutting edge 74 of the angle member 40. The combination of the stress imposed across the tape between positioning member 72 and cutting edge 74 with the low acute angle 75 between the tape and the retaining surface 70 produces a clean cut using any of the conventional paper and plastic or elastic tapes. After the tape segment 92 is severed, the tension and elasticity of the tape draws it back slightly away from the edge 74, and the user can then press it downwardly into a flattened position on surface 70, as shown in FIG. 2, for storage.

Another feature of the invention includes the grooves 98 which are formed in each wall 10 at the upper edge adjacent angle member 40. The size of the grooves is not critical, but they should be sufficiently large to enable the user to fit a finger beneath the adjacent portion of tape and the bottom of groove 98 for gripping the tape when it is desired to lift it and commence using it again.

Figure 6:
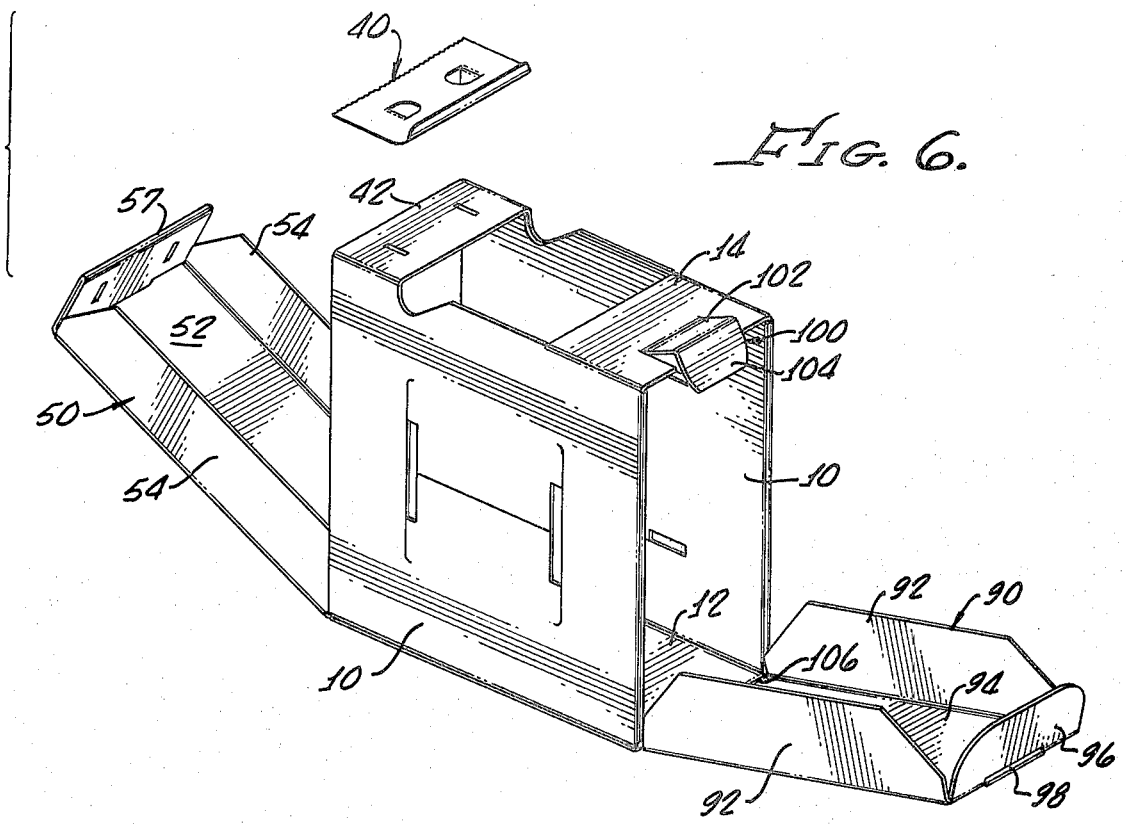
FIG. 6 is an exploded perspective of a preferred embodiment of the dispenser with hinged stiffening panels.
Figure 7:
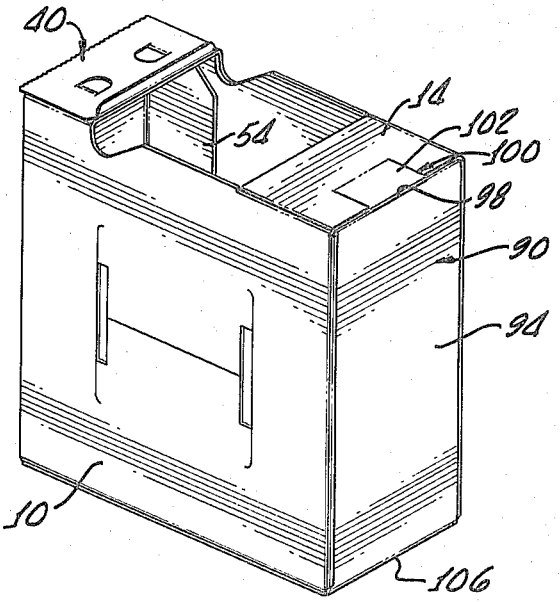
FIG. 7 shows the dispenser of FIG. 6 fully assembled.

FIGS. 6 and 7 show a particularly preferred embodiment of the invention in which there is a rear panel 90 generally corresonding to front panel 50 to give structural support to the rear of the panel and to provide a closure means for securing the roll of tape inside the receptacle. The rear panel 90 includes side insert members 92 corresponding to similar insert members 54 on the front panel and a rear wall portion 94 corresponding to front wall portion 52. The rear panel 90 also includes a top insert member 96 corresponding generally to the double walled folded top insert member 57 of the front panel.

FIG. 7 shows the dispenser of FIG. 6 fully assembled and closed. The rear panel 90 is folded into position about hinge or crease 106, and the front panel 50 is folded into position about a similar crease (not shown). The use of the hinged members thus permits the dispenser to be made of one piece construction, if desired (except for angle member 40). To secure the rear panel in closed position, the top panel 14 is provided with a locking flap 100 having a member 102 and an engaging tab 104 which extends into and engages slot 98 which is located at the intersection of top insert member 96 and rear wall portion 94. This permits easy access to the interior of the dispenser for loading and unloading the tape while at the same time being simple and secure in its construction and performance.

The unique characteristics of the invention permit it to perform consistently, yet permit it to be constructed from conventional cardboards used in prior art dispensers (except for the angle member 70). Generally, the various cardboard components can be pressed or cut from simple geometric configurations and bent and secured into the positions shown by conventional means. Because the force vectors across the cutting edge 74 of angle member 40 are substantially in directions in which there is strong support provided by support panel 42 and stiffening member 50, acting in cooperation with angle member 40, the life of the dispenser greatly exceeds the ordinary life of a roll of tape. Thus, if desired, the dispenser can be used over and over by removing the emptied spool 18 from the dispenser and replacing it with a new roll of tape 16. Alternatively, because the materials are inexpensive, the dispenser can be disposed of along with the empty spool.

Many other uses and variations of the invention will be apparent to those skilled in the art, and while specific embodiments of this invention have been described, these are intended for illustrative purposes only. It is intended that the scope of the invention be limited only by the attached claims.

What is claimed is:

1. A dispenser for storing a roll of pressure-sensitive adhesive tape, dispensing a segment of tape from said roll, and severing said segment therefrom comprising:

a receptacle sized compatibly to contain the roll of tape, said receptacle having an opening for withdrawing tape therethrough from said roll, cutting means for severing a segment of the withdrawn tape, said cutting means comprising a planar member attached to the receptacle and oriented with respect to said opening so that when the cutting means is used for severing said segment the withdrawn tape is positioned with its adhesive side facing said planar member at an acute angle therewith, said planar member lying in a plane outside the periphery of the roll of tape and having a first edge adjacent said opening and a cutting edge for severing said tape remote from said opening, and said cutting means further comprising a positioning member adjacent said first edge, said positioning member having a substantially linear upper edge running substantially parallel to said cutting edge and being at least about two tape thicknesses above said planar member.

2. A dispenser as recited in claim 1 wherein said planar member is at least as wide as said tape and is embossed with multiple protrusions sufficient to endow said member with easy-release characteristics when said adhesive side of said tape is pressed thereagainst.

3. A dispenser as recited in claim 2 wherein the length of said planar member is at least $\frac{1}{4}$ of the width of said tape.

4. A dispenser as recited in claim 2 wherein the length of said planar member is in the range from about $\frac{1}{3}$ to about 1.5 times the width of said tape.

5. A dispenser as recited in claim 2 wherein said receptacle comprises an aligned pair of substantially rectangular side walls, a base wall connecting the lower edges of the side walls, a first top panel connecting corresponding segments of the upper edges of the side walls, said first top panel and side walls defining said opening for withdrawing tape therethrough from said roll.

6. A dispenser as recited in claim 5 wherein said first top panel connects segments of the upper edges of the side walls adjacent the upper rear corners of said side walls, and further including a second top panel connecting segments of the upper edges of the side walls adjacent the forward corners thereof, said first top panel and said second top panel and said side walls defining said opening in the receptacle between the panels for withdrawing tape therefrom.

7. A dispenser as recited in claim 6 wherein the upper edge of at least one of said side walls defines a groove adjacent said second top panel, said groove being sized sufficiently large to permit a user of said dispenser to insert a finger therein.

8. A dispenser as recited in claim 6 further including a stiffening member comprising a planar front panel attached at its upper end to said second top panel, the other end of said front panel abutting said base wall, thereby giving structural support against downward forces on said second top panel.

9. A dispenser as recited in claim 1 wherein said positioning member is substantially planar in shape and is integrally connected to said planar member to form an angle member therewith.

10. A dispenser as recited in claim 9 wherein the height of said positioning member is less than the length of said planar member.

11. A dispenser as recited in claim 9 wherein the height of said positioning member is less than about $\frac{1}{4}$ of the length of said planar member.

12. A dispenser as recited in claim 9 wherein the height of said positioning member is less than about $\frac{1}{8}$ of the length of said planar member.

13. A dispenser for storing a roll of pressure-sensitive adhesive tape, dispensing a segment of tape from said roll, and severing said segment therefrom comprising:

a receptacle sized compatibly to contain the roll of tape, said receptacle comprising an aligned pair of substantially rectangular side walls, a base wall connecting the lower edges of the side walls, a first top panel connecting corresponding segments of the upper edges of the side walls adjacent the upper rear corners thereof, a second top panel connecting segments of the upper edges of the side walls adjacent the forward corners thereof, said first top panel and said second top panel and said side walls defining an opening between the panels for withdrawing tape therethrough from said roll, and cutting means for severing a segment of the withdrawn tape, said cutting means including an angle member having a first planar member positioned on and attached to said second top panel, the forward edge of said planar member extending beyond said forward corner and being sharpened for severing tape, and a second planar member affixed to the rear edge of said first planar member substantially perpendicular thereto, said second planar member being adjacent said opening in the receptacle, said first planar member including embossed multiple protrusions sufficient to endow said member with easy-release characteristics when the adhesive side of said tape is pressed thereagainst, the surface area of the protrusions in contact with the tape constituting less than about 25% of the nominal area of the upper surface of said first planar member, said first planar member having a length in the range from about $\frac{1}{3}$ to about 1.5 times the width of said tape, said second planar member having a substantially linear upper edge running substantially parallel to said forward edge of said first planar member, said upper edge being at least about two tape thicknesses above the tops of said embossed protrusions, and a stiffening member comprising a planar front panel attached at its upper end to said second top panel, the other end of said front panel abutting said base wall, thereby giving structural support against downward forces on said second top panel.

14. A dispenser as recited in claim 13 wherein said other end of said front panel is unitarily connected to said base wall, and wherein there is further included a rear closure for said receptacle, said rear closure member including a rear panel hingedly connected to said base wall at the opposite end thereof from said front panel and further including means connected to said first top panel for releasably engaging said closure means when said closure means is used to close said receptacle.

15. A dispenser for storing a roll of pressure-sensitive adhesive tape, dispensing a segment of tape from said roll, and severing said segment therefrom comprising:

a receptacle sized compatibly to contain a roll of tape, said receptacle having an opening for withdrawing tape therethrough from said roll, and cutting means for severing a segment of the withdrawn tape, said cutting means comprising a planar member attached to the receptacle and oriented with respect to said opening so that when the cutting means is used for severing said segment the withdrawn tape is positioned with its adhesive side facing said planar member at an acute angle therewith, said receptacle including an aligned pair of substantially rectangular side walls, a base wall connecting the lower edges of the side walls, a first top panel connecting corresponding segments of the upper edges of the side walls adjacent the upper rear corners of said side walls, a second top panel connecting segments of the upper edges of the side walls adjacent the forward corners thereof, said first top panel and said second top panel and said side walls defining said opening in the receptacle between the panels for withdrawing tape therefrom, a stiffening member having a planar front panel attached at its upper end to said second top panel, the other end of said front panel abutting said base wall, and a base panel integrally connected to said other end of said front panel substantially perpendicular thereto, said base panel slidably resting on and aligned with said base wall over a substantial portion of the length thereof within said receptacle.

16. A dispenser as recited in claim 15 wherein said cutting means further comprises a positioning member adjacent said first edge, said positioning member having a substantially linear upper edge running substantially parallel to said cutting edge and being at least about two tape thicknesses about the tops of said embossed protrusions.

17. A dispenser as recited in claim 16 wherein said positioning member is substantially planar in shape and is integrally connected to said planar member to form an angle member therewith.

18. A dispenser as recited in claim 17 wherein the height of said positioning member is less than the length of said planar member.

19. A dispenser as recited in claim 18 wherein the height of said positioning member is less than about $\frac{1}{4}$ of the length of said planar member.

20. A dispenser as recited in claim 19 wherein the height of said positioning member is less than about $\frac{1}{8}$ of the length of said planar member.

21. A dispenser as recited in claim 20 wherein the length of said planar member is in the range from about $\frac{1}{3}$ to about 1.5 times the width of said tape.

* * * * *